US006761644B1

(12) United States Patent
Aubert

(10) Patent No.: US 6,761,644 B1
(45) Date of Patent: Jul. 13, 2004

(54) PORTABLE TARGET FOR SPORTING PROJECTILES

(76) Inventor: Gerald Aubert, 22 Springbank Apts Valee des Vaux, St. Helier Jersey (GB), JE2 3TH ( * ) Notice: Subject to any disclaimer, the term of this patent is extended or adjusted under 35 U.S.C. 154(b) by 0 days.

(21) Appl. No.: 10/255,813

(22) Filed: Sep. 25, 2002

(51) Int. Cl.[7] ..... A63B 69/36
(52) U.S. Cl. ..... 473/197; 473/172; 273/400
(58) Field of Search ..... 273/398–402, 273/395, 396, 407; 473/197, 172, 195, 196, 446, 434, 454–456, 435; 108/189, 177, 178, 60, 61

(56) References Cited

U.S. PATENT DOCUMENTS 2,450,125 A * 9/1948 Dunfee ..... 473/163
3,558,140 A * 1/1971 Romeo ..... 473/164
3,822,883 A * 7/1974 De Vos ..... 273/400
3,918,711 A * 11/1975 Zak ..... 473/462
4,326,722 A * 4/1982 Dickens ..... 273/400
4,643,433 A * 2/1987 Wehby ..... 273/402
5,000,461 A * 3/1991 Borazjani ..... 273/401
5,383,562 A * 1/1995 Gay ..... 211/181.1
5,803,842 A * 9/1998 Ross ..... 473/456
2002/0132685 A1 * 9/2002 Fusco ..... 473/454

* cited by examiner

*Primary Examiner*—Mark S. Graham

(57) ABSTRACT

A portable target for golf balls having a frame, a shelf, panels, a wall, partitions, wheel assemblies, and a means to connect the frame components. The frame has legs, stiles, rails, arms, and a header. The stiles and the rails surround the shelf. The panels remain at a right angle to the shelf. The wall is generally at a right angle to the shelf and to the panels. The partitions span between the stiles and divide the shelf. Each leg ends in a wheel. The means to connect involves tongue and groove joints between the frame components and the partitions.

15 Claims, 3 Drawing Sheets

PORTABLE TARGET FOR SPORTING PROJECTILES

BACKGROUND OF THE INVENTION

1. Field of the Invention

The present invention relates to a portable target for sporting projectiles for use in connection with games and sports involving balls. The portable target for sporting projectiles has particular utility in connection with improving accuracy in hitting golf balls at both short and long distances.

2. Description of the Prior Art

Portable targets for sports are desirable for improving accuracy in hit or thrown projectiles, such as golf balls or footballs. Such balls usually travel a long distance. Small deflections during flight of the ball result in wide deviations from the intended landing location of a ball. Ball sports place value upon delivering a ball to a precise location at a distance from the player. Winning players and teams get a ball to the right place. Players practice ball control at every opportunity. During practice, a second player may assist a first player by retrieving balls and by analyzing the first player's performance. Other practice targets provide a target or net for the first player in the absence of a second player.

The use of sports targets is known in the prior art. For example, U.S. Pat. No. 5,370,386 to Parks discloses a sports training target and method. However, the Parks '386 patent does not partition the horizontal bin, and has a further drawback of not permitting a ball to enter the target from above the target.

U.S. Pat. No. 5,976,023 to Cho discloses a collapsible golf net that has mesh material attached to a circular frame held upright. However, the Cho '023 patent does not have partitions, and additionally does not have a rigid frame.

Similarly, U.S. Pat. No. 5,516,115 McLain discloses a portable ball practice target that has mesh material on an upright frame. However, the McLain '115 patent does not have multiple openings, and cannot have a shelf to collect balls.

Similarly, U.S. Pat. No. 6,247,699 to Macaluso discloses a foldable net that forms an upright orientation through rods attached to a frame. However, the Macaluso '699 patent does not have a generally rectangular frame, and cannot have partitions.

Similarly, U.S. Pat. No. 5,524,901 to Bison et al. discloses a sport target apparatus that has a target and retention flaps. However, the Bison '901 patent does not have partitions to divide the target area, and does not have wheels.

Lastly, U.S. Pat. No. Des. 205,040 to Bruns discloses a golf practice target that has a central hole in a panel mounted upon a four-legged stand. However, the Bruns Des. '040 patent does not have partitions in the target area, and has the additional deficiency of no wheels.

While the above-described devices fulfill their respective, particular objectives and requirements, the aforementioned patents do not describe a portable target for sporting projectiles that improves accuracy in hitting golf balls. The Parks '386 patent makes no provision for a divided horizontal bin. The Cho '023 patent also lacks partitions to divide the net. The McLain '115 patent makes no provision for a shelf. The Macaluso '699 patent lacks a rectangular frame and partitions. The Bison '901 and Bruns Des. '040 patents as well lack partitions.

Therefore, a need exists for a new and improved portable target for sporting projectiles that can be used for improving accuracy in hitting golf balls. In this regard, the present invention substantially fulfills this need. In this respect, the portable target for sporting projectiles according to the present invention substantially departs from the conventional concepts and designs of the prior art, and in doing so provides an apparatus primarily developed for the purpose of improving accuracy in hitting golf balls.

SUMMARY OF THE INVENTION

In view of the foregoing disadvantages inherent in the known types of sports targets now present in the prior art, the present invention provides an improved portable target for sporting projectiles, and overcomes the above-mentioned disadvantages and drawbacks of the prior art. As such, the general purpose of the present invention, which will be described subsequently in greater detail, is to provide a new and improved portable target for sporting projectiles and method which has all the advantages of the prior art mentioned heretofore and many novel features that result in a portable target for sporting projectiles which is not anticipated, rendered obvious, suggested, or even implied by the prior art, either alone or in any combination thereof.

To attain this, the present invention essentially comprises a portable sports target for projectiles, such as golf balls, having a frame of components, a shelf, panels, a wall, partitions, wheel assemblies, and a means to connect the frame components. The frame has components of two front legs, two rear legs, two center legs, two spaced apart parallel stiles, two spaced apart parallel rails perpendicular to said stiles, two arms, and a header. The shelf has the stiles and the rails around the perimeter of the shelf. The two panels remain upright and perpendicular to the shelf and have a front leg, an arm, a rear leg, and a rail on their perimeters. The wall is upright and at a generally right angle to the shelf and to the side panels. The rear legs, the stile, and the header form the perimeter of the wall. Between the panels, one or more partitions stand upright, perpendicular to the wall, and parallel to the panels. The partitions span between the stiles and divide the shelf. Each of the front legs, the rear legs, and the center legs has a wheel assembly at one end to move the target. The means to connect involves a tongue and groove joint between the front legs, the rear legs, the center legs, the stiles, the rails, the arms, the header, and the partitions. There has thus been outlined, rather broadly, the more important features of the invention in order that the detailed description thereof that follows may be better understood and in order that the present contribution to the art may be better appreciated.

The invention may also include tongue and grooved piece connecting means, panels and wall of mesh material, partitions that slide into grooved pieces, materials that resist the elements, and a game awarding point values for landing a ball in gaps between different partitions. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and the scope of the present invention.

It is therefore an object of the present invention to provide a new and improved portable target for sporting projectiles that has all of the advantages of the prior art sports targets and none of the disadvantages.

It is another object of the present invention to provide a new and improved portable target for sporting projectiles that may be easily and efficiently manufactured and marketed.

An even further object of the present invention is to provide a new and improved portable target for sporting projectiles that has a low cost of manufacture with regard to both materials and labor, and which accordingly is then susceptible of low prices of sale to the consuming public, thereby making such portable target for sporting projectiles economically available to the buying public.

Still another object of the present invention is to provide a new portable target for sporting projectiles that provides in the apparatuses and methods of the prior art some of the advantages thereof, while simultaneously overcoming some of the disadvantages perpendicularly associated therewith.

Even still another object of the present invention is to provide a portable target for sporting projectiles for improving accuracy in hitting golf balls. This increases player concentration thereby, improving accuracy in hitting projectiles.

Still yet another object of the present invention is to provide a portable target for sporting projectiles for improving accuracy in hitting golf balls. This makes it possible for a target to withstand the impacts of projectiles.

Still yet another object of the present invention is to provide a portable target for sporting projectiles for improving accuracy in hitting golf balls. This makes it possible to position the target at both short and long distances.

Lastly, it is an object of the present invention to provide a new and improved method of improving accuracy in projectile sports by assembling a frame and a shelf, attaching side panels and a wall to form a three sided box upon the legs of a frame, installing partitions upon the shelf, and placing a projectile such as a golf ball into the gap between adjacent partitions.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
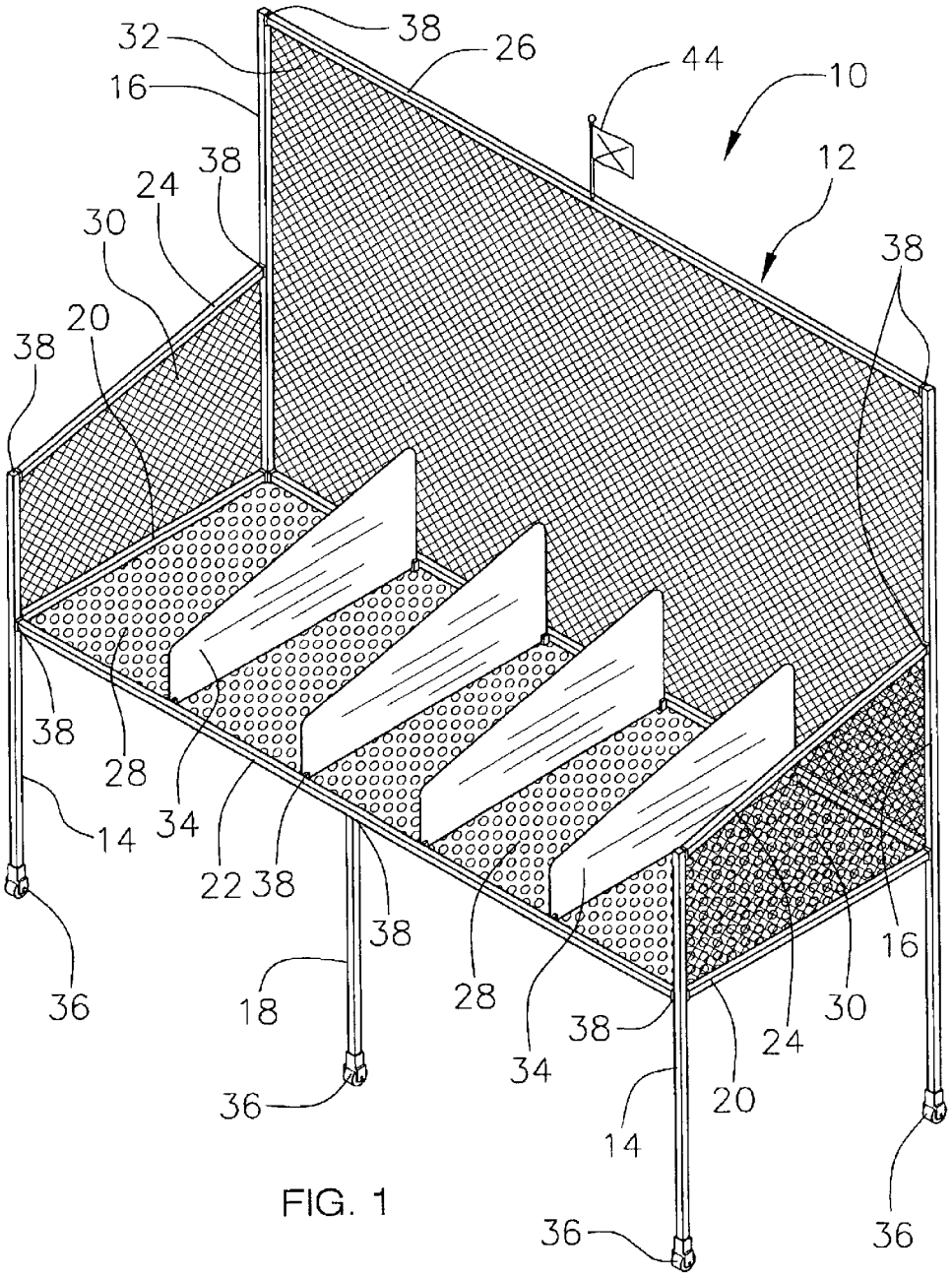
FIG. 1 is a perspective view of the front of the preferred embodiment of the portable target for sporting projectiles constructed in accordance with the principles of the present invention.

Referring now to the drawings, and particularly to FIGS. 1–4, a preferred embodiment of the portable target for sporting projectiles of the present invention is shown and generally designated by the reference numeral 10.

In FIG. 1, a new and improved portable target for sporting projectiles 10 of the present invention for improving accuracy in hitting golf balls is illustrated and will be described. More particularly, the portable target for sporting projectiles 10 has a sheet metal shelf 28, rectangular in shape, with a regular pattern of holes. The holes have a diameter less than the diameter of a regulation golf ball. The shelf 28 attaches above the ground to a frame 12. The frame 12 is made of plastic square tubular components that interconnect. Parallel to the longitudinal axis of the shelf 28, a pair of spaced apart stiles 22 attach to the perimeter of the shelf 28. Perpendicular to the stiles 22, a pair of parallel spaced apart rails 20 completes the perimeter of the shelf 28. The shelf 28 has four comers with two at the front and two at the rear.

The front legs 14 connect with the front comers of the shelf 28. A rail 20 and a stile 22 attach to each front leg 14 with a means to connect 38. The rear legs 16 connect with the rear corners of the shelf 28, opposite the front legs 14. As in the front comers, a rail 20 and a stile 22 attach to each rear leg 16 with a means to connect 38. Both the front legs 14 and the rear legs 16 have a wheel assembly 36 at one end and the means to connect 38 located at the same distance from the wheel assembly 36. Each wheel assembly 36 contacts the ground to support the portable target 10 while allowing for ready relocation of the target 10. The rear legs 16 have greater length than the front legs 14.

A header 26 attaches to both rear legs 16 opposite the wheel assembly 36 with the means to connect 38. A wall 32 affixes to the length of the header 26 and then attaches to the rear legs 16 and a stile 22. The wall 32 denotes the rear of the invention. Mesh material makes up the rectangular shaped wall 32. The longitudinal axis of the wall 32 parallels the longitudinal axes of the shelf 28 and the header 26. At the center of the header 26, a flag 44 extends perpendicular to the header 26 and the shelf 28. The flag 44 indicates wind direction and estimates wind velocity. Perpendicular to the header 26, arms 24 extend from each front leg 14 to each rear leg 16. Each arm 24 attaches to a front leg 14 opposite the wheel assembly 36 and to the rear leg 16 with the means to connect 38. The arms 24 assume an angled position relative to the rails 20. A panel 30 of mesh material, trapezoidal in shape, affixes to the length of the arm 24 and then attaches to the rear leg 16, the rail 20, and the front leg 14.

Centered upon each stile 22, center legs 18 have a wheel assembly 36. Opposite the wheel assembly 36, the center legs 18 join the stiles 22 with the means to connect 38. Each stile 22 also has additional means to connect 38 spaced at varying widths along the length of the stiles 22. Partitions 34 of solid cross section, trapezoidal in shape, fit into the means to connect 38 spaced along the stiles 22 above the shelf 28. The partitions 34 are upright, perpendicular to the shelf 28 and the wall 32, smaller than the panels 30, and parallel to the panels 30. The partitions 34 divide the shelf 28 into two or more gaps. The gaps vary in width with wider gaps farther from the center of the target 10. Each gap has a numeric value shown by markings upon the wall 32 at the rear of a gap. A player places a ball into the gaps using the equipment and the rules of a sport, like golf.

Figure 2:
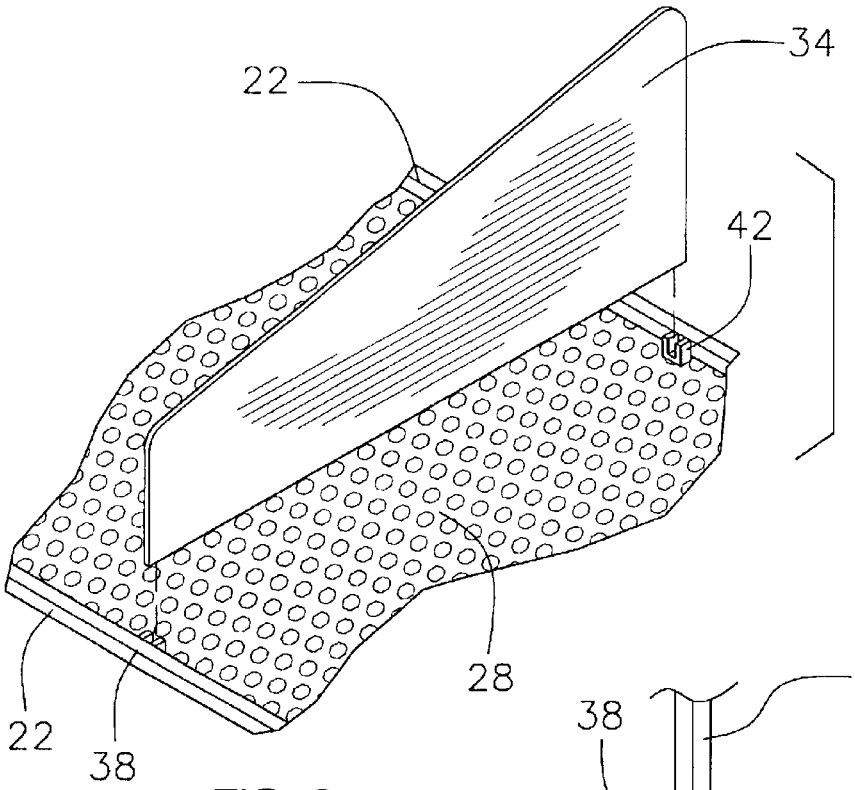
FIG. 2 is a detailed view of a partition connecting to a stile of the portable target for sporting projectiles of the present invention.

Turning to FIG. 2, each partition 34 fits into the means to connect 38. The means to connect 38 have the same spacing on the front and the rear stiles 22. The partitions 34 install perpendicular to both stiles 22 and parallel to the panels 30. Unlike the wall 32, the panels 30, and the shelf 28, the partitions 34 have a solid cross section for rigidity. The partitions 34 remain rigid under the impact of balls and while joined to the frame 12 at two locations. FIG. 2 also illustrates the hole pattern in the shelf 28.

Figure 3:
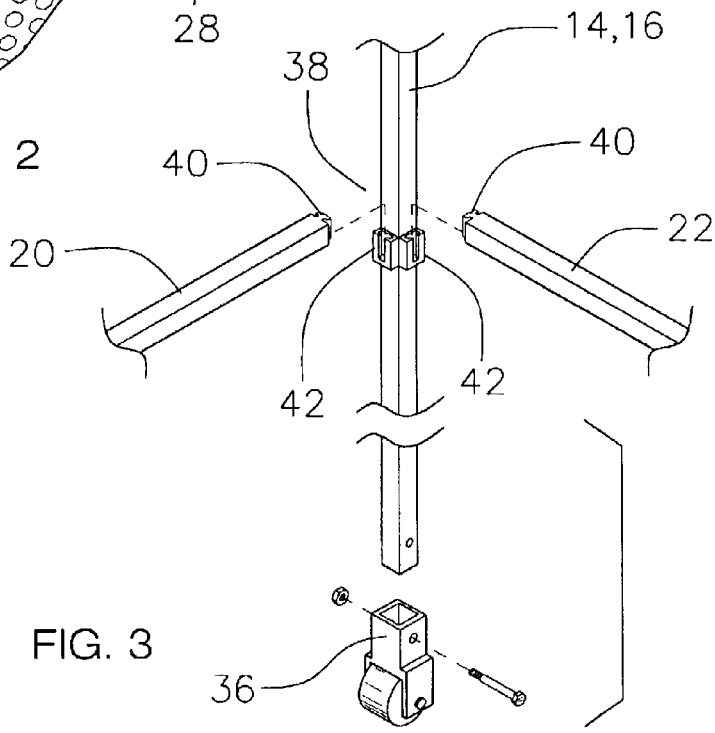
FIG. 3 is a detailed view of a connecting means as a tongue and a grooved piece, and the wheel assembly of the portable target for sporting projectiles of the present invention.

FIG. 3 describes the means to connect 38 and the wheel assemblies in more detail. The means to connect 38 involves a tongue 40 and a matching grooved piece 42. The tongue 40 has a generally T shape when viewed from above. The stem of the T shape extends from an end of the stiles 22, rails 20, arms 24, headers 26, and center legs 18. While the cross piece of the T shape is perpendicular to the longitudinal axis of the frame 12 component. The tongue 40*s* at each end of a frame 12 component are coaxial and oriented parallel to one another. The grooved piece 42 has a generally rectangular shape with a C shape cross-section perpendicular to the longitudinal axis of the grooved piece 42 and having a cap at one end. The cross piece of the T shaped tongue 40 fits within the C shape of the grooved piece 42. The grooved pieces 42 attach by an adhesive individually to the frame 12 components. The grooved pieces 42 have their capped ends located towards the wheel assemblies. In particular the grooved piece 42 at the center of each stile 22 has its capped end located away from the wheel assembly 36 of the center leg. The grooved pieces 42 attach to the surfaces of the front legs 14, the rear legs 16, and the inner surfaces of the stiles 22. The wheel assembly 36 has a solid wheel upon an axle as part of a socket. The socket fits over an end and bolts to the front legs 14, the rear legs 16, and the center legs 18.

Figure 4:
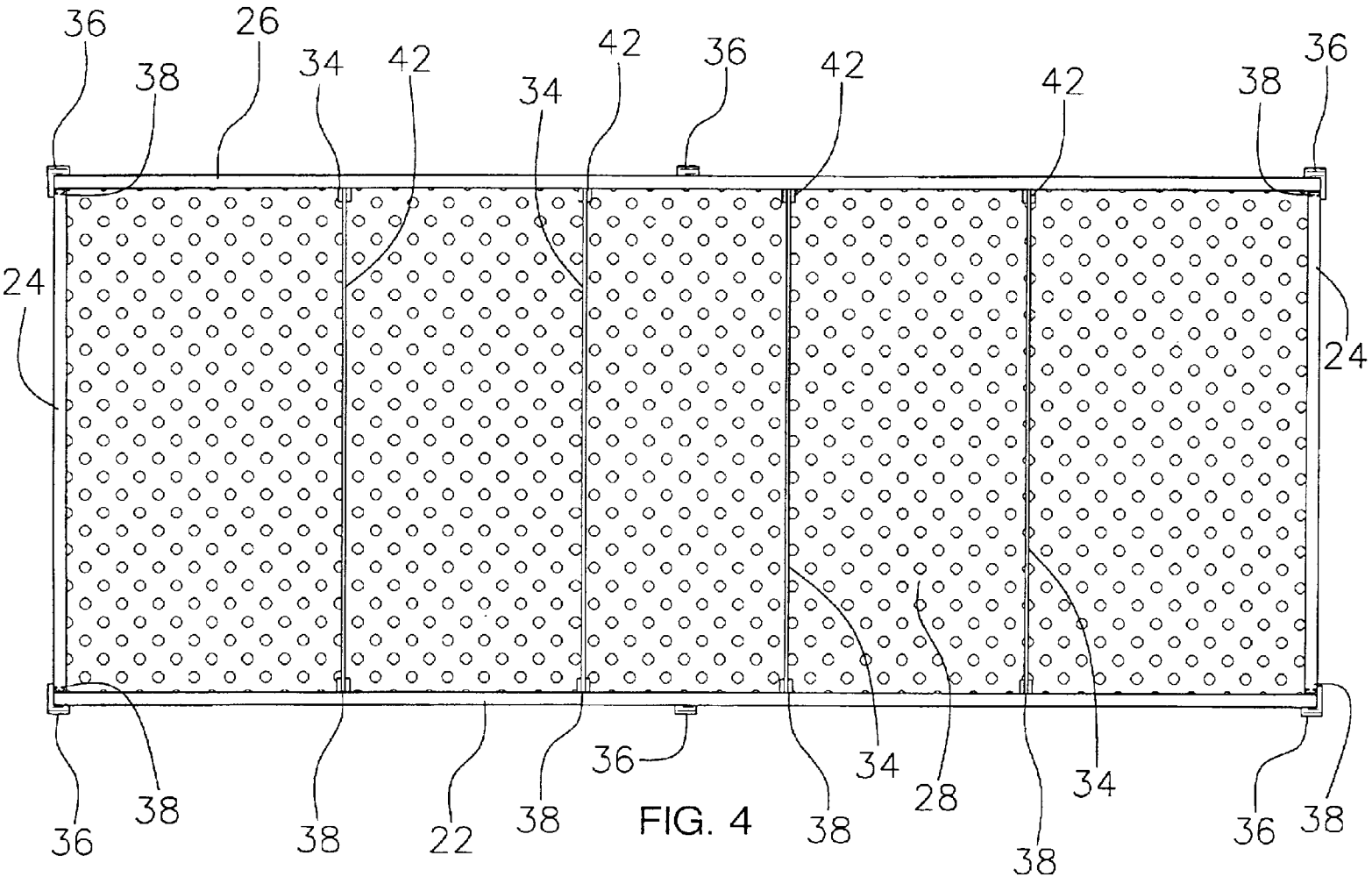
FIG. 4 is a plan view of the shelf divided by the partitions of the portable target for sporting projectiles of the present invention.

In FIG. 4, the target 10 has two or more gaps between partitions 34. The gaps between adjacent partitions 34 have varying widths. The widths increase with the distance from the center of the target 10. Partitions 34 are installed on both sides of the center of the target to but not at the center itself. Beneath the partitions 34, the shelf 28 has holes through the thickness of the shelf 28, and arrayed in a regular pattern. The stiles 22 and rails 20 form the perimeter of the shelf 28 with the header 26 and the arms 24 above their respective stile 22 and rails 20. The wheel assemblies extend out from beneath each leg.

In use, it can now be understood that a player assembles the shelf 28 and surrounding frame 12 components: the rails 20 and the stiles 22. The player then attaches the front legs 14 and the rear legs 16 and arms 24 with the means to connect 38: a tongue 40 and grooved piece 42. After securing the wall 32 and the panels 30, the player then positions the target 10 for the player's sport, like golf. A player may use one or multiple targets 10 positioned at varying distances from a starting point, such as a tee. The player then hits or throws one or more balls at the target 10. After sending all of the balls to the target 10, the player returns to the target 10 and determines how many balls landed in each gap between the partitions 34. To track accuracy or for a game among players, each gap has a numeric value. The numeric value is a marking upon the wall above each gap. A player totals the numeric value for the player's balls located in the various gaps. The numeric value has its highest for the center gap, promoting improving accuracy in hitting or throwing balls. A suggested numeric value scheme has 50 points for the central gap, 25 points for an outer gap, and 10 points for the outermost gap adjacent to the arms 24. The target 10 operates at long distances from the starting point, for driving a golf ball or for throwing a pass or at short distances from the starting point, for chipping a golf ball.

While a preferred embodiment of the portable target for sporting projectiles has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, fiberglass, or a variety of wood may be used instead of the plastic frame components described. Also, the metal shelf may be made of heavy-duty plastic, wood, or similar material. In addition, the grooved piece maybe formed integrally with the frame components, particularly plastic frame components. Although improving accuracy in hitting golf balls has been described, it should be appreciated that the portable target for sporting projectiles herein described is also suitable for other sports and games. Furthermore, a wide variety of projectiles may be used instead of the balls described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable sports target adapted for projectiles, such as golf balls, comprising:

a frame having components of two or more front legs, two or more rear legs, two or more center legs, two or more spaced apart parallel stiles, two or more spaced apart parallel rails perpendicular to said stiles, two or more arms and a header;

a shelf bounded by said stiles and said rails on the perimeter of said shelf;

two or more panels, upright and perpendicular to said shelf bounded by said front leg, said arm, said rear leg, and said rail;

a wall, upright and perpendicular to said shelf and to said side panels bounded by said rear legs, said stile, and said header;

two or more partitions, upright and perpendicular to said wall and parallel to said side panels, spanning between said stiles;

one or more wheel assemblies at an end of said front legs, said rear legs, and said center legs; and, a means to connect said front legs, said rear legs, said center legs, said stiles, said rails, said arms, said header, and said partitions;

said wall and said panels are a mesh material, affixed to at least a portion of said header for said wall, and affixed to at least a portion of said arm and to at least a portion of said stile for each of said panels.

2. The portable sports target of claim 1 wherein said shelf has a rectangular shape with holes of a diameter lesser than said projectile in a regular pattern and said shelf attaches to said rails and to said stiles.

3. The portable sports target of claim 1 wherein said wall has a rectangular shape, said panels are a trapezoidal shape with the shortest edge of the trapezoidal shape at said front leg, and said partitions have a trapezoidal shape smaller than said panels with the shortest edge of the trapezoid at said stile that connects said front legs.

4. The portable sports target of claim 1 wherein said connecting means consists of a tongue and a grooved piece, said tongue being applied upon the ends of said arms, said header, said stiles, and said rails, said grooved piece having a rectangular shape with a C shape cross section on a plane perpendicular to the longitudinal axis of said grooved piece capped at one end whereby, said tongue fits into the opening of the C shape to connect the components of said frame at substantially right angles.

5. The portable sports target of claim 4 wherein said stiles have said grooved pieces affixed to said stiles along the length of said stiles in a pattern and said partitions slide into said grooved pieces upright.

6. The portable sports target of claim 5 wherein said stiles each have said tongue centered upon their length that connects with said grooved piece affixed to an end of said center leg.

7. The portable sports target of claim 1 further comprising, a flag centered upon said header and perpendicular to said shelf, indicating wind direction and estimating wind velocity.

8. A portable sports target, comprising:

a frame having three or more legs, two or more spaced apart parallel stiles, two or more spaced apart parallel rails perpendicular to said stiles, two or more arms, and a header;

a shelf bounded by said stiles and said rails on the perimeter of said shelf;

two or more panels, upright and perpendicular to said shelf bounded by two of said legs, said arm, and said rail, located above said rail;

a wall, upright and perpendicular to said shelf and to said panels, bounded by two of said legs, said stile, and said header;

two or more partitions upright and perpendicular to said wall and parallel to said panels, spanning between said stiles;

one or more wheel assemblies at an end of each of said legs; and, a means to connect said legs, said stiles, said rails, said arms, said header, and said partitions;

wherein said connecting means consists of a tongue and a grooved piece, said tongue being applied upon the ends of said arms, said header, said stiles, and said rails, said grooved piece having a C shape cross section on a plane perpendicular to the longitudinal axis of said grooved piece capped at one end, whereby, said tongue slides into the opening of the C shape cross section to connect the components of said frame.

9. The portable sports target of claim 8 wherein said stiles have said grooved pieces affixed to said stiles at intervals along the length of said stiles and said partitions slide into said grooved pieces upright.

10. The portable sports target of claim 9 wherein the gap between adjacent partitions varies.

11. The portable sports target of claim 8 wherein said wall and said panels are a mesh material resistant to deterioration by sunlight and weather.

12. The portable sports target of claim 8 wherein said wall has markings denoting value upon the surface of said wall and above the gaps between said partitions.

13. The portable sports target of claim 12 wherein said markings have a contrasting color to said wall for enhanced visibility at long distances.

14. The portable sports target of claim 8 wherein each gap between adjacent partitions has a numeric value with lesser value at greater distance from the center of said shelf whereby, a player earns said value by placing a ball into the gap between adjacent partitions.

15. The portable sports target of claim 14 further comprising a plurality of sports targets deployed at a variety of distances from a common point, such as a golf tee box.

* * * * *